US005300905A

United States Patent [19]

Kolbas et al.

[11] Patent Number: 5,300,905

[45] Date of Patent: Apr. 5, 1994

[54] ELECTRICAL POWER DISCONNECT SWITCH WITH BOTH MANUAL AND ELECTRICAL TRIP OPERATION

[75] Inventors: Richard B. Kolbas, Wayne; Claude O. Lanciano, III, Brighton, both of Mich.

[73] Assignee: Ford Motor Company, Dearborn, Mich.

[21] Appl. No.: 963,216

[22] Filed: Oct. 19, 1992

[51] Int. Cl.[5] ..... H01H 9/20

[52] U.S. Cl. ..... 335/167; 335/6; 335/132

[58] Field of Search ..... 335/131-132, 335/27, 26, 126, 167-176

[56] References Cited

U.S. PATENT DOCUMENTS

| | | | |
|---|---|---|---|
| 2,286,375 | 6/1942 | Ray . | |
| 2,591,336 | 4/1952 | Bordelon . | |
| 2,611,843 | 9/1952 | Bourne . | |
| 2,810,804 | 10/1957 | Ryan | 335/27 |
| 3,158,711 | 11/1964 | Piteo . | |
| 3,171,919 | 3/1965 | Hammerly . | |
| 3,193,644 | 7/1965 | Coughlin et al. | 335/27 |
| 3,688,234 | 8/1972 | Yoshino . | |
| 3,733,568 | 5/1973 | Prouty et al. . | |
| 3,925,742 | 12/1975 | Muench . | |
| 4,048,607 | 9/1977 | Smorzaniuk | 335/27 |
| 4,095,213 | 6/1978 | Hayden . | |
| 4,378,543 | 3/1983 | Melter et al. . | |
| 4,631,507 | 12/1986 | Guery et al. . | |

OTHER PUBLICATIONS

Albright Corp., Emergency Battery Disconnect Switches technical description and figures (Jul., 1984).

*Primary Examiner*—Lincoln Donovan

*Attorney, Agent, or Firm*—Paul K. Godwin; Roger L. May

[57] ABSTRACT

An electrical power disconnect switch is disclosed which provides for mechanical or manual tripping operation, as well as electrical or automatic tripping operation. The switch includes a latch pin, a switch body including a handle member, and fixed and movable contacts. A biasing spring biases the contacts to an open position. The latch pin has an electrical trip coil surrounding it to cause the latch pin to releasably hold the switch body in a position such that the contacts are closed. The latch pin is retracted from the switch body by manual depression of a handle member, causing the contacts to open. Alternatively, the latch pin is released from the switch body to open the contacts when current ceases to flow through the electrical trip coil. The current flowing through the electrical trip coil is supplied from a protection circuit. In an automobile application, the protection circuit may be, for example, a hood open or crash detection circuit.

11 Claims, 2 Drawing Sheets

ELECTRICAL POWER DISCONNECT SWITCH WITH BOTH MANUAL AND ELECTRICAL TRIP OPERATION

BACKGROUND OF THE INVENTION

1. Field of the Invention

The present invention relates generally to the field of power disconnect switches. More particularly, the invention relates to an electrical power disconnect switch in which the trip operation of the switch is capable of being performed both manually and electrically.

2. Related Art

Disconnect switches are commonly found on a variety of electrically operated industrial equipment. Such switches are also employed in automobiles. The primary function of disconnect switches is to remove a machine or piece of equipment, or more generically speaking, a "load", from a power source. Representative disconnect switches and relays include those of U.S. Pat. No. 2,591,335, issued to Bordelon, U.S. Pat. No. 2,286,375 issued to Ray, and U.S. Pat. No. 4,095,213, issued to Hayden.

It is often desirable that the disconnect switch open automatically to remove the load from the power source. Automatic disconnection may be advisable when an alarm condition is present, such as when a malfunction in the load or other equipment occurs, or when the equipment is turned off. For example, in the disconnect switch for an automobile described in the Hayden patent referenced above, a coil becomes energized when the automobile ignition is turned on, and electro-magnetic forces are created which hold the electrical contacts together. When the ignition switch is turned off, the coil is deenergized and the contacts open.

Additionally, it is often desirable that the disconnect switch be manually operable, in order to provide a "panic button" feature. Manual disconnection of the load is also done when routine maintenance on the equipment is performed. The present invention provides new and advantageous techniques for providing a disconnect switch having both electrical (or automatic) and manual tripping characteristics.

SUMMARY OF THE INVENTION

In a first aspect, the present invention provides a switch for disconnecting a load from an electrical power source having mechanical and electrical trip operation. The switch comprises a pair of fixed (or first) electrical contacts, and a switch body comprising a handle or button member, a shaft, and movable (or second) electrical contacts interconnected to the shaft. A main spring or other means for biasing the switch body to the second position is also provided. The switch body is reciprocable between first and second positions such that when the switch body is in the first position, the contacts are closed, thereby connecting the load to the power source. When the switch body is in the second position, the contacts are open, thereby disconnecting the load from the power source. The switch further comprises a latch pin operatively associated with the switch body. The latch pin releasably holds the switch body in the first position against the biasing force of the main spring, such that the contacts are closed, that is, when the load is connected to the electrical power source. Preferably, the latch pin has a tip portion which releasably engages a lockout notch on the staff of the switch body.

Latch means are provided for releasably holding the switch body in the first position against the force of the biasing means. Preferably, for example, an electrical trip coil carrying a current from a protection circuit is wound around the latch pin. When current flows through the electrical trip coil, electromagnetic forces are imparted to the latch pin to cause the latch pin to releasably hold the switch body in the first position. When electrical current is interrupted in the electrical trip coil, as when a failure or alarm condition is present in the protection circuit, the electromagnetic forces imparted by the coil dissipate and a hold-out spring releases the latch pin from the switch body. The main spring then operates to move the switch body to the second position, resulting in the opening of the contacts. The protection circuit can be of a wide variety of possible circuits. The particular circuit will depend upon the particular application of the switch. For example, in an automotive application, the protection circuit may be a hood open detection circuit.

A manual disconnect linkage interconnects the handle member and the latch pin. The manual disconnect linkage is provided for manually disconnecting the latch pin from the switch body, causing disconnection of the load from the power source.

Thus, the first and second contacts are opened, disconnecting the load from the power source, either manually, i.e.. upon activation of the manual disconnect linkage, or electrically, i.e., upon interruption of the current in the electrical disconnect coil.

These and other aspects and features of the invention will become apparent from the following detailed description of the preferred and alternative embodiments of the invention and the accompanying figures.

BRIEF DESCRIPTION OF DRAWINGS

Presently preferred and alternative embodiments of the invention are illustrated in the accompanying drawings, in which.

DETAILED DESCRIPTION OF THE PREFERRED EMBODIMENT

Figure 1:
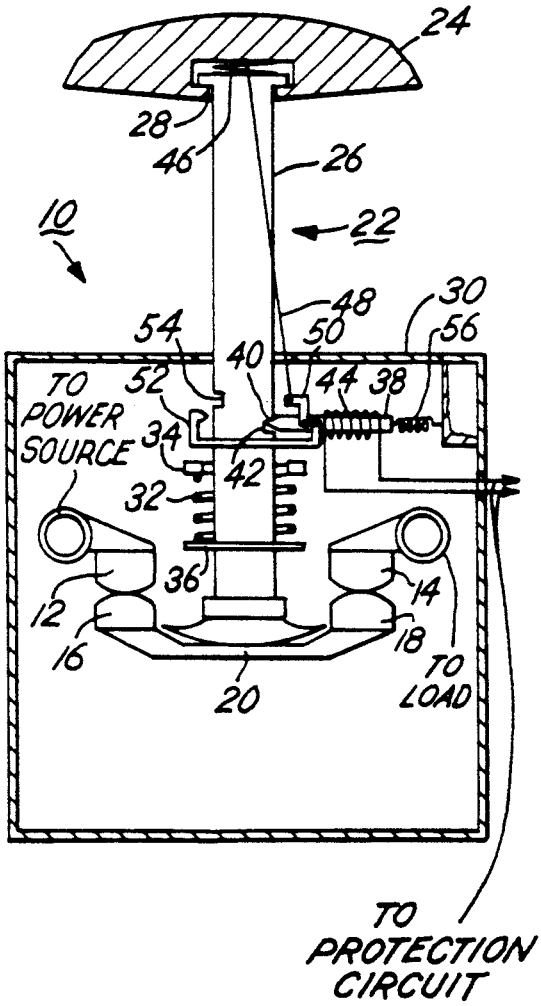
FIG. 1 is a cross-sectional schematic view of an electrical power disconnect switch according to the preferred embodiment of the invention, showing the position of the components thereof when the fixed and movable contacts are in a closed position.

Referring now to FIG. 1, there is illustrated a cross-sectional schematic view of a electrical power disconnect switch 10 which has both mechanical and electrical tripping functions according to a presently preferred embodiment of the invention. FIG. 1 shows the position of the various components of the switch 10 when the switch 10 is in a closed condition. More specifically, in FIG. 1, fixed (or first) contacts 12, 14, are provided which are in electrical communication with an electrical power source and load, respectively. Movable (or second) contacts 16 and 18 are provided, and an electrically conductive bridging contact member 20 spans the movable contacts 16, 18 such that when the movable contacts 16, 18 are in contact with the fixed contacts 12, 14, as shown in FIG. a pathway for current exists between the power source and the load. While the power source and load will, of course, vary depending upon the particular installation or application of the switch, the present description of the preferred embodiment envisions an electric vehicle installation of the switch 10, in which case the power source is the vehicle battery system and the load is the electric motor powering the drive train of the vehicle.

The switch 10 includes a switch body, generally indicated by reference numeral 22. The switch body comprises a handle member 24, a shaft 26 received within an opening 28 in the handle member 24, the movable contacts 16, 18 and the bridging contact member 26. A main spring 32 is provided between a stop 34 and a flange 36. The main spring 32 biases the switch body 22 to the lower or second position. Comparing FIG. 1 with FIG. 2, it will be seen that the switch body 22 reciprocates relative to the housing 30 between a first or upper position, contacts closed, shown in FIG. 1, and a second or lower position, contacts open, shown in FIG. 2.

Figure 3:
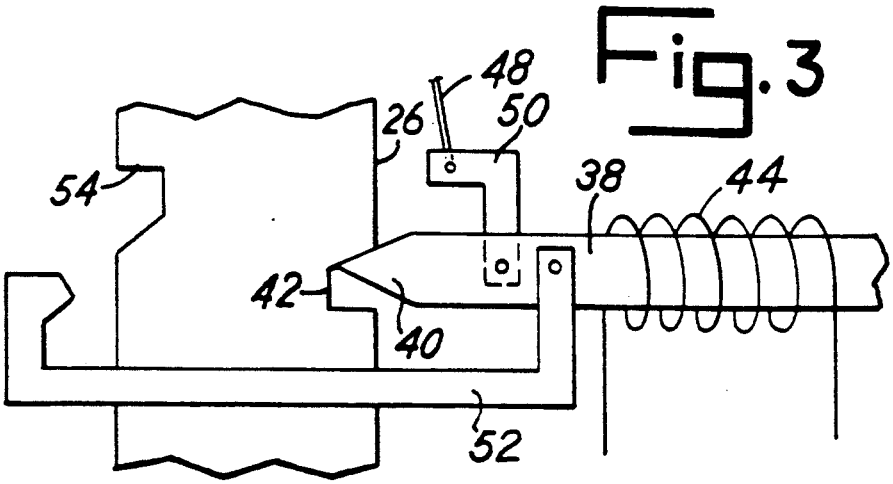
FIG. 3 is a cross-sectional, enlarged and isolated view of the latch pin and shaft members of FIG. 1, shown when the contacts are maintained in a closed position.

Referring to FIGS. 1 and 3, a latch pin 38 is operatively associated with the switch body 22 to releasably hold the switch body in the first position when the electrical power source is connected to the load. The latch pin 38 is provided with a tip portion 40 which engages a complimentary lockout notch 42 in the shaft 26 of the switch body 22. The tip portion 40 of the latch pin 38 is inserted into the lockout notch 42, and releasably holds the switch body in the first or upper position against the biasing force of the main spring 32.

The electrical trip coil 44 provides the force necessary to insert and hold the latch pin 38 in the lockout notch 42 to maintain the switch body 22 in the first position, as shown in FIG. 1. The electrical trip coil 44 is supplied with current from a protection circuit (described in more detail below). The latch pin 38 is preferably made out of a ferrous material in order to pass magnetic fluxes induced by the electrical trip coil 44. When current from the protection circuit flows through the coil, sufficient electromagnetic forces are induced in the latch pin 38 in the direction of the shaft 26 to prevent the spring 32 from moving the switch body 22 to the lower position to open the contacts 12, 14 and 16, 18.

Referring again to FIG. 1, as noted earlier, the switch 10 also includes an electrical tripping function. The electrical trip coil 44 is in circuit with one or more suitable protection circuits, for example, in a motor vehicle application, a hood open detection circuit, or an inertial switch (a crash detection circuit). Another example of a possible protection circuit, where the load is an electric motor, is a motor controller or overcurrent sensor circuit. Still other possibilities for the protection circuit are a discrete emergency stop button circuit or an external rescue switch. In the present design, as long as current from the protection circuit is supplied to the electrical trip coil 44, indicated a normal or non-alarm condition in the protection circuit, the tip 40 of the latch pin 38 will be held against the lock out notch 42 and the contacts will remain closed. The protection circuit is designed such that a failure or alarm condition detected by the protection circuit causes interruption or discontinuance of the current supplied to the electrical trip coil 44. When this current is interrupted, the electromagnetic forces induced in the latch pin 38 which cause the latch pin 38 to hold the switch body 22 in the upper position dissipate. The hold-out spring 56 then is able to retract the latch pin 38 from the lockout notch 42. Once the tip 40 of the latch pin 38 clears the lockout notch 42, the main spring 32 is able to push down the switch body 22 to open the contacts 12, 14 and 16, 18.

Figure 2:
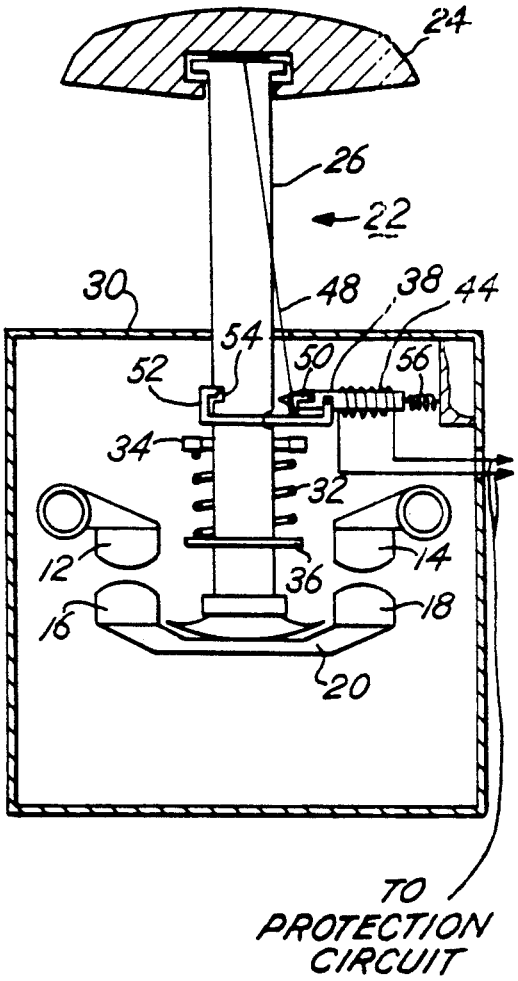
FIG. 2 is a cross-sectional schematic view of the switch of FIG. 1 showing the position of the components thereof when the fixed and movable contacts are in an open position.
Figure 4:
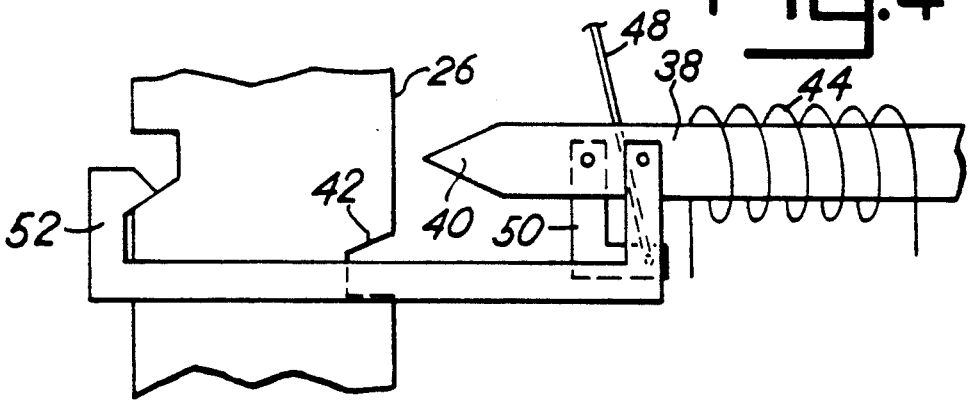
FIG. 4 is a cross-sectional, enlarged and isolated view of the latch pin and shaft members of FIG. 2, shown when the contacts are maintained in an open position.

A manual disconnect linkage is provided which interconnects the handle member 24 and the latch pin 38. The purpose of the manual disconnect linkage is to manually release the latch pin from the switch body 22 to open the contacts 12, 14 and 16, 18. The linkage includes an spring 46, a manual trip rod 48 interconnected to the handle member 24, and an L-shaped member 50 pivotably mounted on the latch pin 38. The spring 46 biases the handle member 24 to an extended or upper position relative to the shaft 26 as shown in FIG. 1. When the handle member 24 is lightly depressed against the spring 46, the rod 48 pivots the L-shaped member about an axis to force the latch pin 38 out of the lockout notch 42, overriding the electrical trip coil 44. As soon as the tip 40 of the latch pin 38 clears the lockout notch 42, the main spring 32 pushes the switch body 22 to the lower position to open the contacts. FIG. 2 is cross-sectional, schematic view of the switch 10 when the switch 10 is in an open condition. FIG. 4 is a enlarged, fragmentary, and isolated view of the latch pin 38 and switch body 22 when the switch 10 is in the open condition. Referring now to FIGS. 2 and 4, the forcible retraction of the latch pin 38 from the lockout notch 42 permits the lockout pin 52 to engage the second lockout notch 54 on the opposite side of the shaft 26, to thereby hold the contacts in the open position.

The switch 10 further includes a manual override feature. If, for some reason, activation of the mechanical trip linkage by slight depression of the handle member 24 fails to open the contacts 12, 14 and 16, 18, the operator may push down more strenuously on the handle member 24 to override the electrical trip coil 44 to force the latch pin out of the lockout notch 42, and to thereby open the contacts 12, 14 and 16, 18.

Once the contacts 12, 14 and 16, 18 are open, as shown in FIG. 2, and the user wishes to close the contacts, the user simply pulls up on the handle member 24. The protection circuits must first be cleared, however, as the lockout pin 52 will not be forced out of the lockout notch 54 until current from the protection circuit is flowing through the electrical trip coil 44. When the circuits have cleared and the current flows through the electrical trip coil 44, the handle member 24 can be pulled back to its upper position (FIG. 1) such that the latch pin 38 releasably holds the switch body 22 in the upper position.

Figure 5:
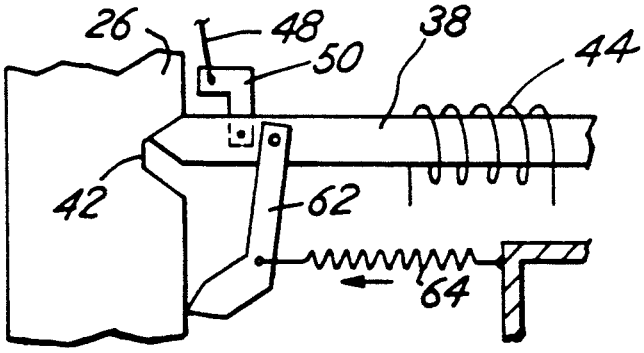
FIG. 5 is a cross-sectional view of an alternative configuration for the lockout pin of FIGS. 1 and 2 according to an alternative embodiment of the invention, shown when the contacts are maintained in a closed position.
Figure 6:
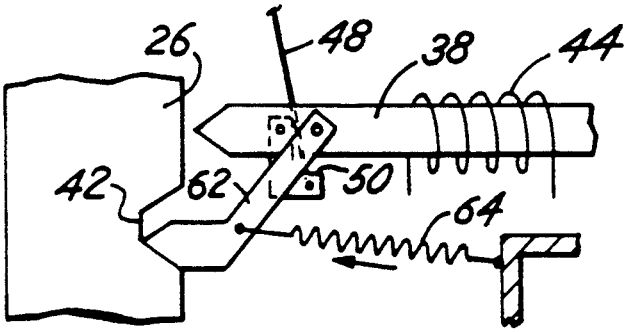
FIG. 6 is a cross-sectional view of an alternative configuration for the lockout pin of FIGS. 1 and 2 according to an alternative embodiment of the invention, shown when the contacts are maintained in an open position.

An alternative construction of a lockout pin 62 is shown in FIG. 5 and FIG. 6. In FIG. 5, the latch pin 38 releasably holds the shaft 26 of the switch body in the upper position corresponding to FIG. 1. A lockout pin 62 is shown depending downwardly from the latch pin 38. A biasing spring 64 biases the lockout pin against the shaft 26. When the manual or electrical tripping function operates, the shaft 26 is moved downward such that the lockout pin 62 engages the lockout notch 42 to hold the contacts (12, 14, and 16, 18, see FIG. 2) in the open position. Pulling up on the handle member 24 (FIG. 2) causes the lockout pin 62 to be urged out of the lockout notch 42 such that the latch pin 38 reengages the notch 42 to releasably hold the switch body as described hereinbefore.

While we have described presently preferred embodiments of our invention, it will be understood that other designs are possible without departure from the true spirit and scope of the invention. Further, those of ordinary skill will realize that indicating devices such as LEDs may be provided to indicate the status of the switch. Other arrangements of the manual disconnect linkage may also be suitable. This true scope and spirit is defined by the appended claims, to be interpreted in light of the foregoing specification.

What is claimed is:

1. An apparatus for disconnecting a load from an electrical power source having mechanical and electrical tripping operation, comprising:

a) first electrical contacts;

b) a switch body comprising a handle member, a shaft and second electrical contacts interconnected to the shaft, the switch body reciprocable between first and second positions such that the contacts are closed connecting the load to the power source when the switch body is in the first position, the contacts being open disconnecting the load from the power source when the switch body is in the second position;

c) means for biasing the switch body to the second position;

d) latch means operatively associated with the switch body for releasably holding the switch body in the first position against the biasing force of the biasing means;

e) manual disconnect means for releasing the latch means from the switch body, thereby causing disconnection of the load from the power source; and f) electrical disconnect means associated with the latch means for releasing the latch means from the switch body to disconnect the load from the power source;

g) lockout means engaging said switch body for holding said switch body in said second position upon release of said latch means from said switch body.

2. An apparatus for disconnecting a load from an electrical power source having mechanical and electrical tripping operation, comprising:

a) first electrical contacts;

b) a switch body comprising a handle member, a shaft and second electrical contacts interconnected to the shaft, the switch body reciprocable between first and second positions such that the contacts are closed connecting the load to the power source when the switch body is in the first position, the contacts being open disconnecting the load from the power source when the switch body is in the second position;

c) means for biasing the switch body to the second position;

d) latch means operatively associated with the switch body for releasably holding the switch body in the first position against the biasing force of the biasing means;

e) manual disconnect means for releasing the latch means from the switch body, thereby causing disconnection of the load from the power source; and f) electrical disconnect means associated with the latch means for releasing the latch means from the switch body to disconnect the load from the power source;

wherein the handle member is reciprocable relative to the shaft between upper and lower positions, and wherein the manual disconnect means comprises a rod linking the top handle to the latch means and a spring biasing the top handle to the upper position relative to the shaft, whereby movement of the top handle to the lower position causes the latch means to release the switch body, causing disconnection of the load from the power source.

3. An apparatus for disconnecting a load from an electrical power source having mechanical and electrical tripping operation, comprising:

a) first electrical contacts;

b) a switch body comprising a handle member, a shaft and second electrical contacts interconnected to the shaft, the switch body reciprocable between first and second positions such that the contacts are closed connecting the load to the power source when the switch body is in the first position, the contacts being open disconnecting the load from the power source when the switch body is in the second position;

c) means for biasing the switch body to the second position;

d) latch means operatively associated with the switch body for releasably holding the switch body in the first position against the biasing force of the biasing means;

e) manual disconnect means for releasing the latch means from the switch body, thereby causing disconnection of the load from the power source; and f) electrical disconnect means associated with the latch means for releasing the latch means from the switch body to disconnect the load from the power source;

wherein the latch means comprises a latch pin operatively associated with the shaft, and wherein the electrical disconnect means comprises an electrical trip coil surrounding the latch pin.

4. The apparatus as claimed in claim 3 wherein a holding current is supplied to the electrical trip coil thereby urging the latch pin into engagement with the switch body.

5. The apparatus as claimed in claim 3 wherein the electrical trip coil is in circuit with a protection circuit, the protection circuit supplying the electrical trip coil with a holding current to thereby urge the latch pin into engagement with the switch body.

6. The apparatus as claimed in claim 5 wherein the electrical power disconnect switch is placed between a power source and an electric motor, and wherein the protection circuit comprises an overcurrent sensor circuit for the electric motor.

7. The apparatus as claimed in claim 5 wherein the electrical power disconnect switch is installed in a vehicle and the protection circuit comprises a crash detection circuit.

8. The apparatus as claimed in claim 5 wherein the electrical power disconnect switch is installed in a vehicle and the protection circuit comprises a hood open detection circuit.

9. A disconnect switch for disconnecting a load from a power source, comprising:

a) first electrical contacts;

b) a switch body comprising a handle member, a shaft and second electrical contacts interconnected to the shaft, the switch body reciprocable between first and second positions such that when the switch body is in the first position, the contacts are closed thereby connecting the load to the power source, and such that when the switch body is in the second position, the contacts are open thereby disconnecting the load from the power source:

c) a spring biasing the switch body to the second position:

d) a latch pin operatively associated with the switch body for releasably holding the switch body in the first position against the biasing force of the spring such that the first and second contacts are in electrical contact with one another to connect an electrical power source to the load;

e) a manual disconnect linkage interconnecting the top handle to the latch pin whereby depression of the top handle releases the latch pin from the switch body thereby causing the switch body to move to the second position, disconnecting the load from the power source; and f) an electrical trip coil surrounding the latch pin, the coil supplied with a holding current to hold the switch body in the first position such that interruption of the holding current releases the latch pin from the switch body, thereby causing the switch body to move to the second position, disconnecting the load from the power source.

10. The apparatus as claimed in claim 9 wherein the latch pin further comprises a lockout pin operatively associated with the switch body, whereby the lockout pin retains the switch body in the second position when the latch pin is released from the switch body.

11. The apparatus as claimed in claim 9 and further comprising a hold-out spring biasing the latch pin to a retracted position relative to the switch body.

* * * * *